US007000301B2

(12) United States Patent
Moushon et al.

(10) Patent No.: US 7,000,301 B2
(45) Date of Patent: Feb. 21, 2006

(54) SOCKET LIFE-EXTENDING DRIVING TOOL

(76) Inventors: Robert W. Moushon, 1924 Rossie Lee, Bossier City, LA (US) 71112; Gaylan W. Moushon, 566 Ronda Ct., Calimesa, CA (US) 92320

( * ) Notice: Subject to any disclaimer, the term of this patent is extended or adjusted under 35 U.S.C. 154(b) by 0 days.

(21) Appl. No.: 10/665,983

(22) Filed: Sep. 19, 2003

(65) Prior Publication Data

US 2004/0211047 A1 Oct. 28, 2004

Related U.S. Application Data

(60) Provisional application No. 60/412,384, filed on Sep. 20, 2002.

(51) Int. Cl.
*B25B 27/14* (2006.01)

(52) U.S. Cl. ..... 29/275; 29/255

(58) Field of Classification Search ..... 29/275, 29/254–255; 90/275; 30/119, 358, 366; 10/16, 7; 227/151; 72/412, 324, 478, 477; 83/71; 173/90, 131, 132, 128; 81/463, 121.1, 81/129.6, 177.2
See application file for complete search history.

(56) References Cited

U.S. PATENT DOCUMENTS 3,064,342 A * 11/1962 Wagoner ..... 29/275
4,229,870 A * 10/1980 Tate ..... 29/254
4,791,837 A * 12/1988 Main ..... 81/63.1
5,218,749 A * 6/1993 Upthegrove ..... 29/275
5,967,004 A * 10/1999 Isbister ..... 81/177.2

* cited by examiner

*Primary Examiner*—Robert C. Watson
(74) *Attorney, Agent, or Firm*—Steven J. Adamson

(57) ABSTRACT

A seal driving tool for use with sockets or like devices that are used to position seals. The driving tool may have multiple segments including a force receiving member, an extender and an adapter. All, some or one of these items may be used in accordance with the present invention. The seal driving tool affords extended socket life and flexibility of use situations to the user.

15 Claims, 2 Drawing Sheets

SOCKET LIFE-EXTENDING DRIVING TOOL

CROSS REFERENCE TO RELATED APPLICATIONS

This application claims the benefit of U.S. Provisional Application No. 60/412,384, filed Sep. 20, 2002, and having the same title and inventor(s) as above.

FIELD OF THE INVENTION

The present invention relates to seal drivers and, more specifically, to reducing damage to sockets that are mis-used as seal drivers.

BACKGROUND OF THE INVENTION

Many machines have a spinning or sliding shaft about which seals are provided. Seals typically include a rigid, metal ring or disc interior of which is mounted a flexible rubber or other suitable material. Seals are often used to prevent or reduce lubricant leakage and prevent the accumulation of dust and dirt around ball-bearings or other devices that provide low-friction support to a shaft. Other seal arrangements are also known in the art.

Seal drivers have been developed to mount seals into position for subsequent insertion of a shaft into the seal. Typically these drivers consist of a set of sturdy discs or like members that are coupled to a driving member. In use, a disc is placed adjacent a seal and the driving member is struck, creating a force that transfers through the driving member to the disc and then the seal, driving the seal into position.

A disadvantageous aspect of current seal driver sets is that they are very expensive, based in part on the specialized nature of the device. Due to their significant expense, many individual mechanics typically do not have a set of seal drivers and larger shops tend to have one set to be shared by several mechanics, leading to situations in which a desired seal driver size is not available.

A less expensive alternative to seal drivers is sockets—a standard accessory for most mechanics. Use of a socket is also advantageous because their hollow cylindrical structure permits driving of a seal onto a shaft, whereas the flat discs typically used in seal drivers as described above do not. When using a socket as a seal driver, a mechanic selects the socket size that approximates the size of a given seal and drives that seal into position by striking the socket with a hammer 15 or the like. This use, which is illustrated in FIG. 1, constitutes "mis-use" of the socket 16 and often damages the socket resulting in significantly shorted product life. Notwithstanding damage to the sockets, it is standard practice in many shops to drive seals 18 with sockets.

This practice is in part exacerbated by tool companies that offer life-time tool warranties that allow mechanics to simply replace the damaged sockets at no charge to the mechanic. This results in financial loss to the tool maker and unnecessary and undesirable resource consumption to generate new sockets.

SUMMARY OF THE INVENTION

Given the propensity of mechanics to use sockets to drive seals, it is an object of the present invention to provide a device for driving seals with sockets in a manner that significantly reduces damage to the sockets and thus extends their useful life.

It is another object of the present invention to provide such a device that accommodates sockets of various sizes.

It is also an object of the present invention to provide such a device that has an extender mechanism for driving seals located at a distance from the seal driver striking surface.

These and related objects of the present invention are achieved by use of a socket life-extending driving tool as described herein.

The attainment of the foregoing and related advantages and features of the invention should be more readily apparent to those skilled in the art, after review of the following more detailed description of the invention taken together with the drawings.

DETAILED DESCRIPTION

Figures 1, 2, 3:
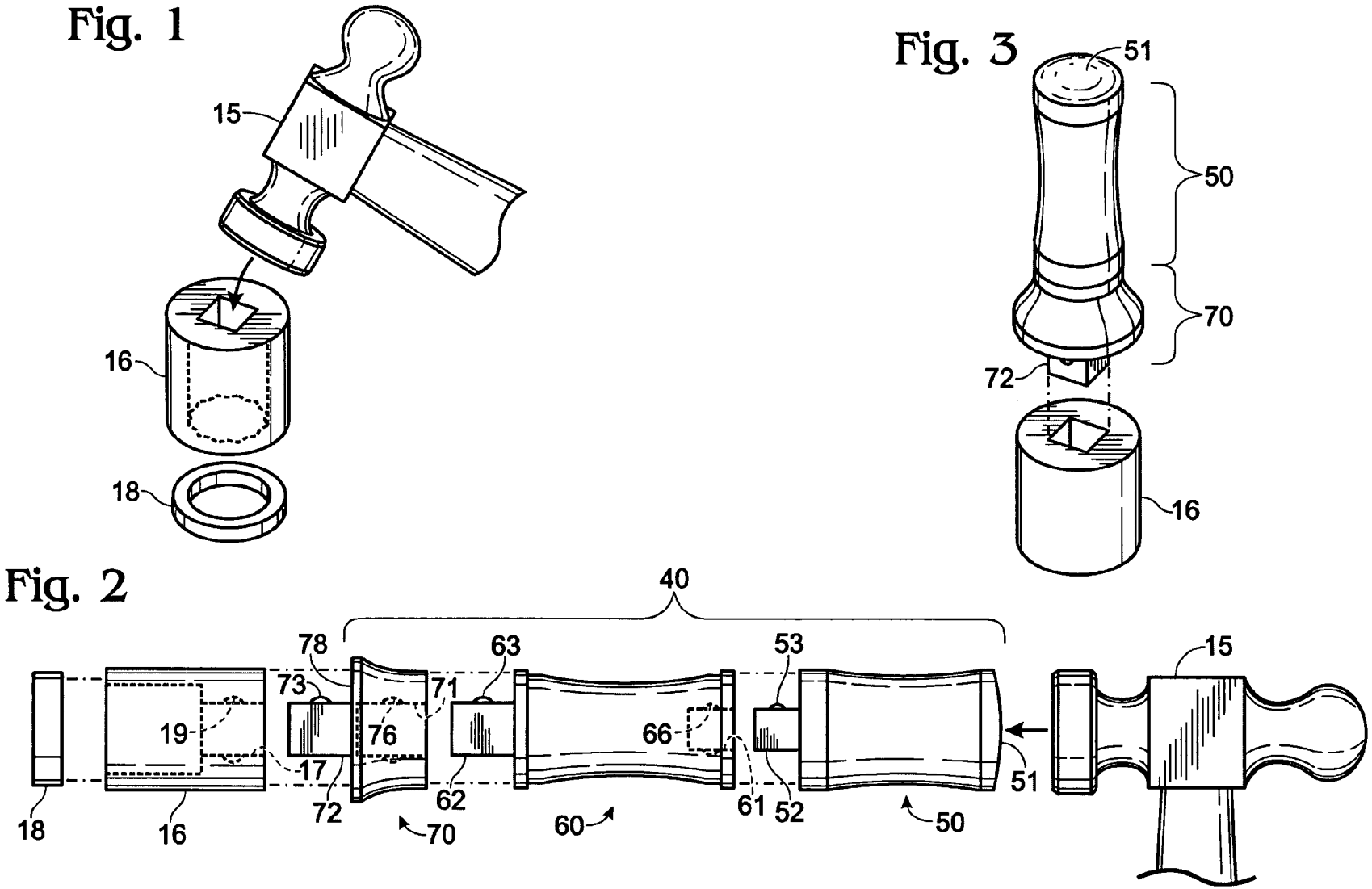
FIG. 1 is a diagram of a hammer striking a socket used to drive a seal.
FIG. 2 is a diagram of a socket driving device in accordance with the present invention.
FIG. 3 is a perspective view of the device of FIG. 3, excluding the extender, in accordance with the present invention.

Referring to FIG. 2, a diagram of a socket driving device 40 in accordance with the present invention is shown. The socket driving device 40 includes a driving shaft 50, an extender 60 and an adapter 70. In use, a socket 16 is mounted to adapter 70 and aligned with seal 18. A hammer 15 delivers a driving force through driving shaft 50 that translates through driving device 40 onto socket 16 and seal 18.

Driving shaft 50 is preferably formed of a solid or similarly rigid structure and includes a striking surface 51 on one end and a coupling protrusion 52 on the other end. The striking surface is configured to withstand repeated hammer strikes. Driving shaft 50 is preferably circular in lateral cross-section to distribute driving force, though other cross-sectional shapes may be used without departing from the present invention. The driving shaft may be coupled through extender 60 to adapter 70 or directly to adapter 70 (as shown in FIG. 3) or directly to a socket 16.

Extender 60 preferably has a lateral cross-sectional shape that is similar to that of the driving shaft. The extender includes a recess 61 for receiving coupling protrusion 52 and a coupling protrusion 62 for coupling into adapter recess 71. Coupling protrusion 52 preferably includes a biased ball bearing 53 or the like that positively engages coupling notch 66. Similarly, coupling protrusion 62 preferably includes a biased ball bearing 63 or the like that positively engages coupling notch 76. Note that the extender may be provided in various lengths.

Adapter 70 includes a coupling protrusion 72, which may be the same or different size as that of the driving shaft or extender. Adapter 70 may have a cylindrical, conical, fluted or other shape. A fluted configuration is shown in FIG. 2. The fluted, conical or like shape serves to distribute driving force across socket coupling surface 78, resulting in more uniform application of force onto socket 16. Coupling protrusion 72 preferably includes a biased ball bearing 73 or the like that positively engages coupling notch 19 of socket recess 17.

While the driving shaft, extender and adapter are shown in a linear, inner-connected arrangement in FIG. 2, it should be recognized that the present invention may be practiced with less than all three components. As noted above, the driving shaft may be coupled directly to socket 16 or to adapter 70. In addition, the driving shaft and extender may be coupled directly to a socket, i.e., without adapter 70.

It should also be recognized that the coupling protrusions of the driving shaft and the adapter may be differently sized. For example, the coupling protrusion 52 of the driving shaft 50 may be ⅜" square while the coupling protrusion of the adapter may be ½" square. This enables device 40 to accommodate a greater range of socket sizes. It may also serve to better distribute driving force from the driving shaft to larger sized sockets. It should also be recognized that a plurality of different size adapter could be provided to accommodate different size sockets.

The driving shaft, extender and adapter are preferably made of hardened steel or other material that is standard is socket manufacture. Alternatively or in combination, parts of the driving shaft, extender and/or adapter may be made of a hard plastic or resin or other material as are the handles of some wood chisels and the like.

Referring to FIG. 3, a perspective view of device 40, excluding extender 60, is shown in accordance with the present invention. In use, socket 16 would be mounted on the coupling protrusion 72 of adapter 70, and a hammer would strike striking surface 51, thereby transferring a driving force to a seal aligned with the socket.

Figure 4B:
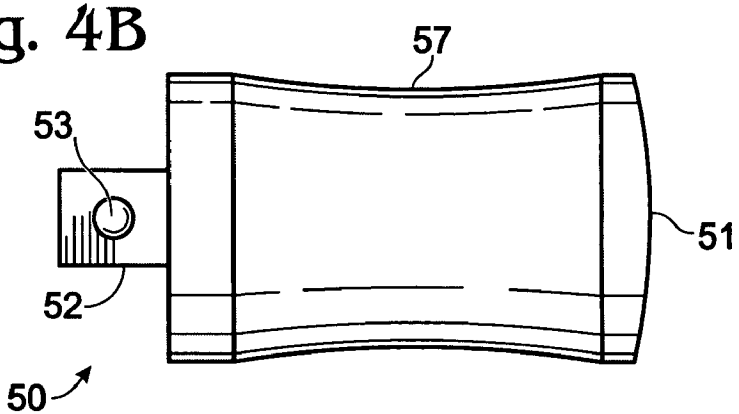
FIGS. 4A–4B are an end view and a side view of a driving shaft in accordance with the present invention.
Figure 4A:
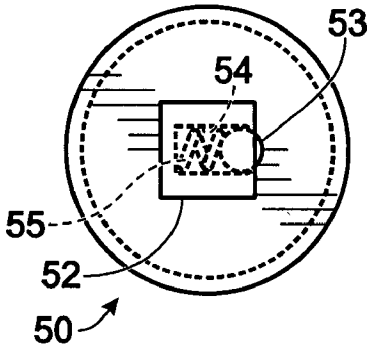

Referring to FIGS. 4A–4B, an end view and a side view of driving shaft 50 in accordance with the present invention are respectively shown. The end view illustrates a ball bearing 53 resident in groove 54 in protrusion 52. The ball bearing is biased by spring 55 and when inserted into an extender, adapter or socket engages coupling notch 66, 76 or 19 in that part.

Side view, FIG. 4B, illustrates the position of ball bearing 53 in protrusion 52 and the opposing arrangement of striking surface 51 and protrusion 52. Holding section 57 is provided between the striking surface and the protrusion. Holding section 57 includes a tapered depression for ease of holding during use. Other configurations and/or the use of a rubber "no-slip" grip of the like could also be provided in this section.

Figure 5C:
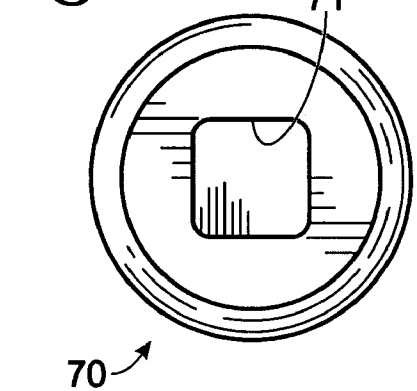
FIGS. 5A–5C are an end view, a side view and the other end view of an adapter in accordance with the present invention.
Figure 5B:
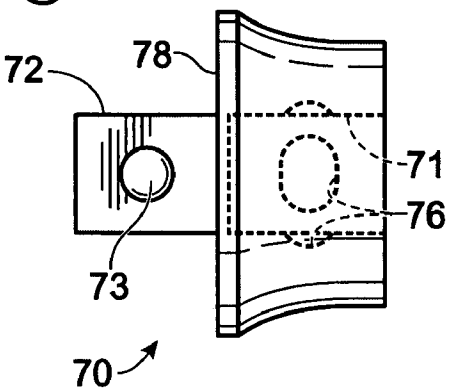
Figure 5A:
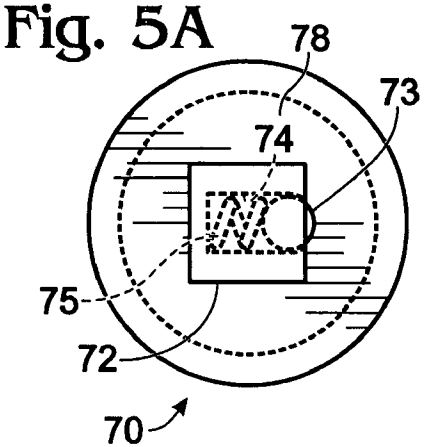

Referring to FIGS. 5A–5C, an end view, side view and other end view of adapter 70 in accordance with the present invention are respectively shown. FIG. 5A illustrates the socket coupling surface 78 and protrusion 72 that includes a ball bearing 73, groove 74 and spring 75 as discussed above for driving shaft 50 (extender protrusion 62 includes similar components).

Side view, FIG. 5B, illustrates the arrangement of protrusion 72, recess 71 and the remainder of the adapter body. The other end view illustrates the location of recess 71, amongst other features.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A socket driving device, comprising:

a first member having a longitudinally disposed driving shaft formed of a durable, rigid material and configured to have a striking surface end and a distally located mounting end;

the striking surface end having a first lateral cross-sectional area and the mounting end having a second lateral cross-sectional area that is substantially the same as the first lateral cross-sectional area;

a first coupling protrusion extending from the mounting end, the first coupling protrusion being substantially square in lateral cross-section;

a second member having a receiving end that is configured to releaseably receive the mounting end of the first member and a distally located socket-mounting end, the first member being longer in the longitudinal dimension than the second member in that same dimension;

the receiving end having a third lateral cross-sectional area and the socket-mounting end having a fourth lateral cross-sectional area, wherein the fourth lateral cross-sectional area is greater than the third lateral cross-sectional area and the lateral cross-sectional area of the second member expands from the third cross-sectional area to the fourth cross-sectional area; and a second coupling protrusion extending from the socket-mounting end, the second coupling protrusion being substantially square in lateral cross-section.

2. The device of claim 1, wherein the lateral cross-sectional area of the second member expands substantially continuously from the receiving end to the socket-mounting end.

3. The device of claim 1, further comprising:

an extender having a first member coupling end and a second member coupling end;

the extender having a fifth lateral cross-sectional area that is substantially the same as the first or second lateral cross-sectional areas.

4. The device of claim 1, wherein the second member has a substantially flared shape, expanding towards the socket-mounting end.

5. The device of claim 1, wherein the the first coupling protrusion and the second coupling protrusion have different sized lateral cross-sectional areas.

6. The device of claim 3, wherein the extender is configured for releasable coupling between the first member and the second member to extend the distance of the second member from the first member.

7. The device of claim 1, wherein the second lateral cross-sectional area of the first member mounting end and the third lateral cross-sectional area of the second member receiving end are substantially the same.

8. The device of claim 1, wherein the first member has a substantially uniform lateral cross-sectional area along its longitudinal length to transfer a striking force from the striking surface end to the mounting end, while having a tapered depression towards a mid-span thereof.

9. A socket driving device for driving a socket used in seal mounting or other purposes, comprising:

a socket driving member configured to be held by a human hand when in use and including a striking surface, a socket mounting surface and a socket engaging mechanism;

said striking surface being formed of a metallic material and configured to withstand a driving blow;

said socket mounting surface being provided substantially opposite said striking surface and being substantially planar and radially disposed so as to provide a substantially uniform drive force to a socket being driven by said device; and said socket engaging mechanism including a socket coupling protrusion configured for releasable coupling to a socket;

wherein said socket driving member includes a first section and a second section, said first section including said striking surface and said second section including said mounting surface and said socket engaging mechanism, said first and second sections being releasably couplable to one another;

wherein said first section includes a first section protrusion and said second section includes a complementary coupling recess, wherein said first section protrusion is configured for coupling to at least one of said second section and a socket;

wherein said first section protrusion and said socket coupling protrusion have different lateral cross-sectional areas to accommodate different sized sockets; and wherein the lateral cross-sectional area of said second section at said mounting surface is greater than the lateral cross-sectional area of said second section where the second section couples to the first section.

10. The device of claim 9, wherein said second section expands in lateral cross-sectional area from where said second section couples to said first section to said mounting surface.

11. The device of claim 9, wherein said second section has a substantially flared shape, expanding in lateral cross-sectional area towards said mounting surface.

12. The device of claim 9, wherein said first section is greater in a longitudinal dimension than in a lateral dimension and greater in the longitudinal dimension than said second section.

13. The device of claim 9, wherein said first section protrusion and said socket coupling protrusion each have a lateral cross-sectional shape that is substantially square.

14. The device of claim 9, further comprising a third section, said third section being removably coupled between said first and second sections to extend the distance from said striking surface to said mounting surface and socket engaging mechanism.

15. The device of claim 13, wherein the wherein said first section protrusion and said socket coupling protrusion have different lateral cross-sectional areas to releaseably couple to and drive different sized sockets.

* * * * *